US008333430B2

(12) United States Patent
Adams et al.

(10) Patent No.: US 8,333,430 B2
(45) Date of Patent: Dec. 18, 2012

(54) ADIRONDACK CHAIR

(75) Inventors: William E. Adams, Portersville, PA (US); Robert Schreiber, Prospect, PA (US)

(73) Assignee: Adams Mfg. Corp., Portersville, PA (US)

( * ) Notice: Subject to any disclaimer, the term of this patent is extended or adjusted under 35 U.S.C. 154(b) by 344 days.

(21) Appl. No.: 12/475,778

(22) Filed: Jun. 1, 2009

(65) Prior Publication Data

US 2010/0301644 A1 Dec. 2, 2010

(51) Int. Cl.
*A47C 3/04* (2006.01)

(52) U.S. Cl. ..... 297/239; 297/452.63; 297/181

(58) Field of Classification Search ..... 297/183.1, 297/239, 452.3, 452.31, 452.63
See application file for complete search history.

(56) References Cited

U.S. PATENT DOCUMENTS

| | | | | |
|---|---|---|---|---|
| D109,239 | S | | 4/1938 | Wolpin |
| 2,192,672 | A | | 3/1940 | Connor, Jr. |
| 2,195,461 | A | | 4/1940 | Koenig |
| 2,222,296 | A | | 11/1940 | Luiken |
| 2,517,039 | A | | 8/1950 | Shook |
| 2,600,626 | A | | 6/1952 | Ellingson |
| 2,650,652 | A | | 9/1953 | Watson |
| 2,843,195 | A | * | 7/1958 | Barvaeus ..... 297/284.4 |
| 3,845,986 | A | * | 11/1974 | Rowland ..... 297/239 |
| 4,541,670 | A | * | 9/1985 | Morgenstern et al. ..... 297/284.7 |
| 5,044,691 | A | * | 9/1991 | Guichon ..... 297/239 |
| 5,120,071 | A | | 6/1992 | Thibault et al. |
| 5,240,214 | A | * | 8/1993 | Birnbaum et al. ..... 248/231.41 |
| 5,911,469 | A | | 6/1999 | Young |
| 5,997,094 | A | * | 12/1999 | Cvek ..... 297/452.15 |
| 6,003,946 | A | * | 12/1999 | Jackson ..... 297/377 |
| 6,616,228 | B2 | * | 9/2003 | Heidmann ..... 297/284.4 |
| 6,688,687 | B2 | * | 2/2004 | Chu ..... 297/284.4 |
| 6,986,549 | B2 | * | 1/2006 | Kniese ..... 297/284.1 |
| D538,086 | S | * | 3/2007 | Shake ..... D6/502 |
| 7,401,854 | B2 | * | 7/2008 | Adams ..... 297/239 |
| D607,223 | S | * | 1/2010 | Adams et al. ..... D6/370 |
| 7,748,786 | B1 | * | 7/2010 | Brower ..... 297/423.41 |
| 2005/0200167 | A1 | | 9/2005 | Bollenbach |
| 2006/0163920 | A1 | | 7/2006 | Adams |

* cited by examiner

*Primary Examiner* — David Dunn
*Assistant Examiner* — Erika Garrett
(74) *Attorney, Agent, or Firm* — Buchanan Ingersoll & Rooney PC

(57) ABSTRACT

An Adirondack chair having a lumbar support is disclosed. The chair includes a seat and a back attached to the seat. A lumbar support is provided on the back. The lumbar support defines a longitudinally convex front surface and at least one laterally concave front surface. Preferably, the seat, back and lumbar support are integrally molded as a unitary structure. The back may also be molded to include a headrest.

13 Claims, 15 Drawing Sheets

ADIRONDACK CHAIR

FIELD OF INVENTION

The present invention relates to Adirondack chairs.

BACKGROUND OF THE INVENTION

Adirondack chairs are a larger type of chair and are very popular. For many years, these chairs were made of wood with the pieces of the chair nailed, glued, bolted, or screwed together to form a single unit. The chair has a straight back that is formed by multiple wooden planks that extend from a seat at an angle. Most wooden Adirondack chairs are not foldable. They are heavy and also very difficult to stack. Adirondack chairs have not been made or sold with headrests or lumbar supports.

More recently, some Adirondack chairs have been made of plastic. These chairs are molded to look like the old wooden Adirondack chairs. Such molded chairs generally did not include headrests or lumbar supports.

U.S. Patent Application Publication No. 2006/0163920 to Adams discloses foldable Adirondack chairs. The chairs may be stacked on top of each other by folding the rear legs to a position substantially parallel to the seat and subsequently positioning nesting the chair within a second chair. Unfortunately, this method of stacking Adirondack chairs can provide a stack of chairs that is not straight. Often, the stack of Adirondack chairs disclosed in U.S. Patent Application Publication No. 2006/0163920 has a forward lean, which can cause the stack of chairs to fall down.

Further, Adirondack chairs often do not provide a lumbar support or a headrest for a seated user. Perhaps one reason why Adirondack chairs have not been made with lumbar supports is because the chair back is inclined backwards at a fixed angle relative to the seat. Simply placing a conventional lumbar support on the chair back may work for some people but can make certain users uncomfortable. For instance, a lumbar support of an Adirondack chair may be positioned such that it only provides desirable support to a person of a particular height. Shorter or taller seated users may be made less comfortable by such a lumbar support. The same problem exists with headrests. This is a particularly troublesome problem for Adirondack chairs due to the size and configuration of the seat and back portions of such chairs.

This magnitude of the inconsistent comfort and support a lumbar support or headrest may provide a user is even greater for Adirondack chairs that are integrally molded as a unitary structure because of the costs associated with forming the molding dies for such chairs. It is not cost effective to make different chairs having different lumbar supports or headrests in different molds. Due to the costs associated with molding lumbar supports or headrests and because the conventional lumbar supports and headrests can make some users uncomfortable, plastic molded Adirondack chairs do not include lumbar supports or headrests. In fact, it is believed that plastic molded Adirondack chairs with fixed backs have never included lumbar supports.

An Adirondack chair is needed that includes a lumbar support and a headrest. Preferably, one universal lumbar support and headrest is provided in such chairs to provide comfortable support to most, if not all, users seated in an Adirondack chair. Such chairs would also preferably include a mechanism for permitting the Adirondack chairs to be vertically stacked on top of each other such that the stacked chairs are substantially straight.

SUMMARY OF THE INVENTION

An Adirondack chair composed of a polymeric material is provided that includes a seat, a back attached to the seat, and a lumbar support attached to and preferably molded as part of the back. The seat, back and lumbar support are integrally molded as a unitary structure. The back includes a plurality of members that each extends upwardly from the seat at an angle of 40° to 50° relative to at least a portion of the seat to define a laterally concave front surface. The lumbar support has a plurality of supports that define at least one longitudinally convex front surface and at least one laterally concave front surface. Each support is attached to a respective member of the plurality of members of the back.

In some embodiments of the Adirondack chair, the plurality of members of the back include a first member, a second member, a third member, a fourth member, a fifth member and a sixth member positioned adjacent to each other such that the members define five gaps. A first gap is defined between the first and second members. A second gap is defined between the second and third members. A third gap is defined between the third and fourth members. A fourth gap is defined between the fourth and fifth members and a fifth gap is defined between the fifth and sixth members. It should be understood that other embodiments of the Adirondack chair can include a back that includes more than six members or less than six members and more than five gaps or less than six gaps. Preferably, the back members are arranged to provide a gap along a center portion of the back that is designed to align with a seated user's spine to improve the comfort experienced by a seated user suffering from spinal stenosis.

In one embodiment of the chair, the supports of the lumbar support can include a first longitudinally convex support attached to the first member, a second longitudinally convex support attached to the second member, a third longitudinally convex support attached to the third member, a fourth longitudinally convex support attached to the fourth member, a fifth longitudinally convex support attached to the fifth member and a sixth longitudinally convex support attached to the sixth member. Preferably, the supports of the lumbar support do not cover any of the gaps. In some embodiments, the first and sixth support each have a maximum thickness of 0.77 inches, the second and fifth supports have a maximum thickness of 0.65 inches, and the third and fourth supports have a maximum thickness of 0.51 inches.

Embodiments of the Adirondack chair may include a chair base. For instance, the chair base may include a plurality of legs or a pedestal. The chair is preferably composed of plastic such as ABS, polypropylene or polycarbonate.

In some embodiments of the Adirondack chair, each member of the plurality of members includes a top portion that extends forwardly relative to the middle portion and extends to a position above and in front of the longitudinally convex front surface of the lumbar support. Preferably, the top portions of these members define a headrest.

In one embodiment of the Adirondack chair, a rib is attached to at least one of the plurality of members of the back. The one or more ribs extend beyond the rear of the member. Preferably, the rib is sized and configured to engage a chair back of another Adirondack chair to permit substantially straight chair stacking.

Other embodiments of the Adirondack chair can include a back attached to the seat at an angle of 95° to 115° relative to at least a portion of the seat. The portion of the seat may be the rearmost portion of the seat that is adjacent the back or a rearmost portion of the seat that is in engagement with a portion of the back. A lumbar support is attached to the back that includes a longitudinally convex front surface. The lumbar support extends from about 3.5 inches above a portion of the seat to about 11 inches above the portion of the seat such that a portion of the convex front surface of the lumbar support is about 0.5 inches away form the back. Preferably, the portion of the convex front surface of the lumbar support that is about 0.5 inches away form the back is in the center of the convex front surface of the lumbar support. In some embodiments of the Adirondack chair, the lumbar support can be composed of material that is softer or more flexible than the material of the back of the chair to provide additional comfort.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of our Adirondack chair and present preferred methods of making and using the same are shown in the accompanying drawings.

DETAILED DESCRIPTION OF PRESENT PREFERRED EMBODIMENTS

Figure 1:
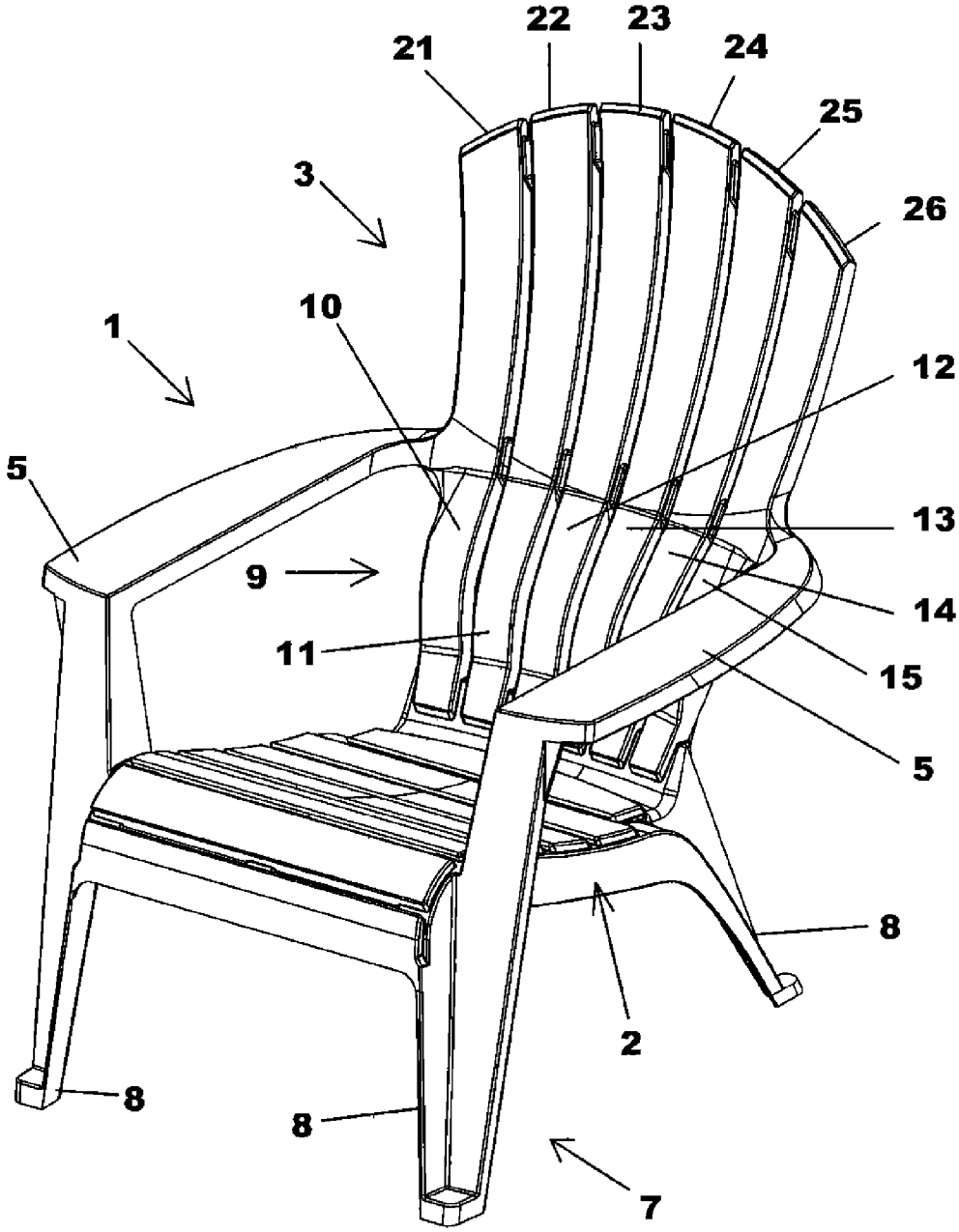
FIG. 1 is a perspective view of a first present preferred embodiment of the Adirondack chair.
Figure 2:
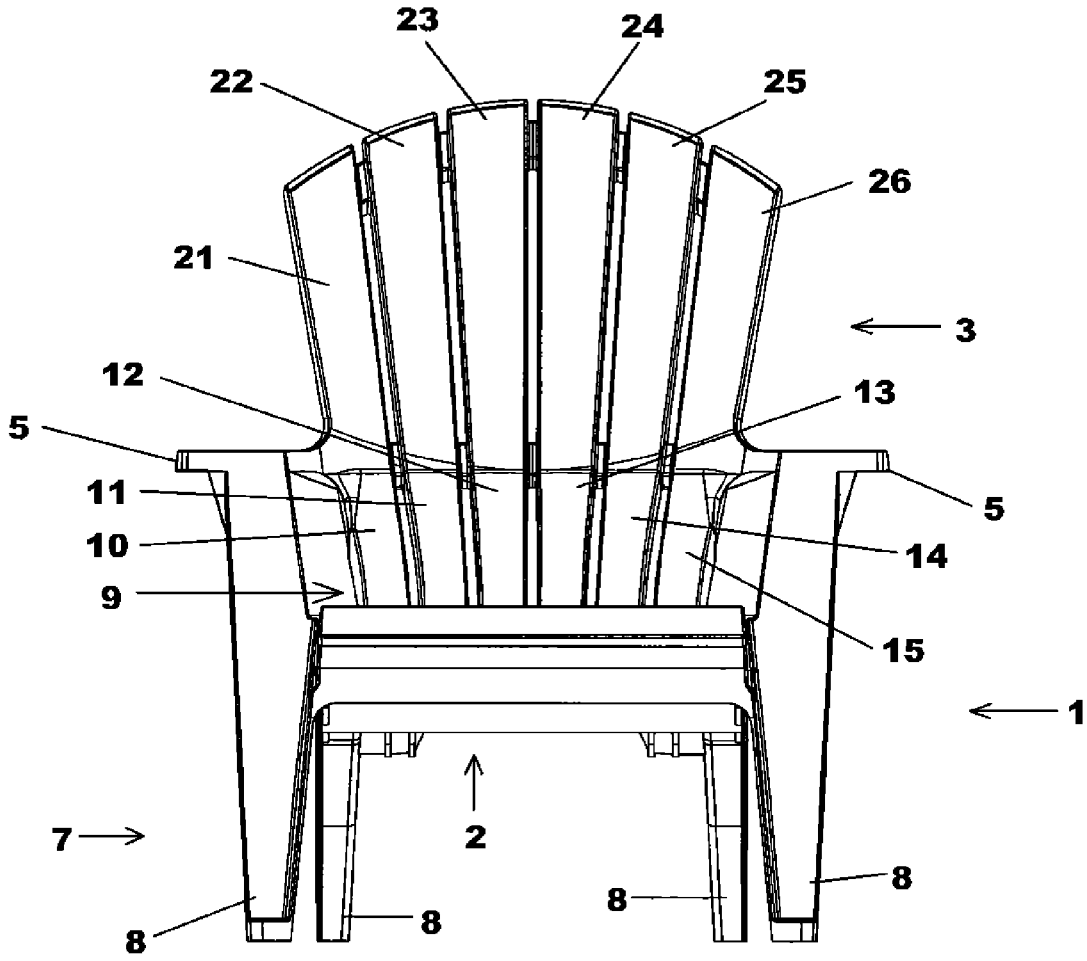
FIG. 2 is a front view of the first present preferred embodiment of the Adirondack chair.
Figure 3:
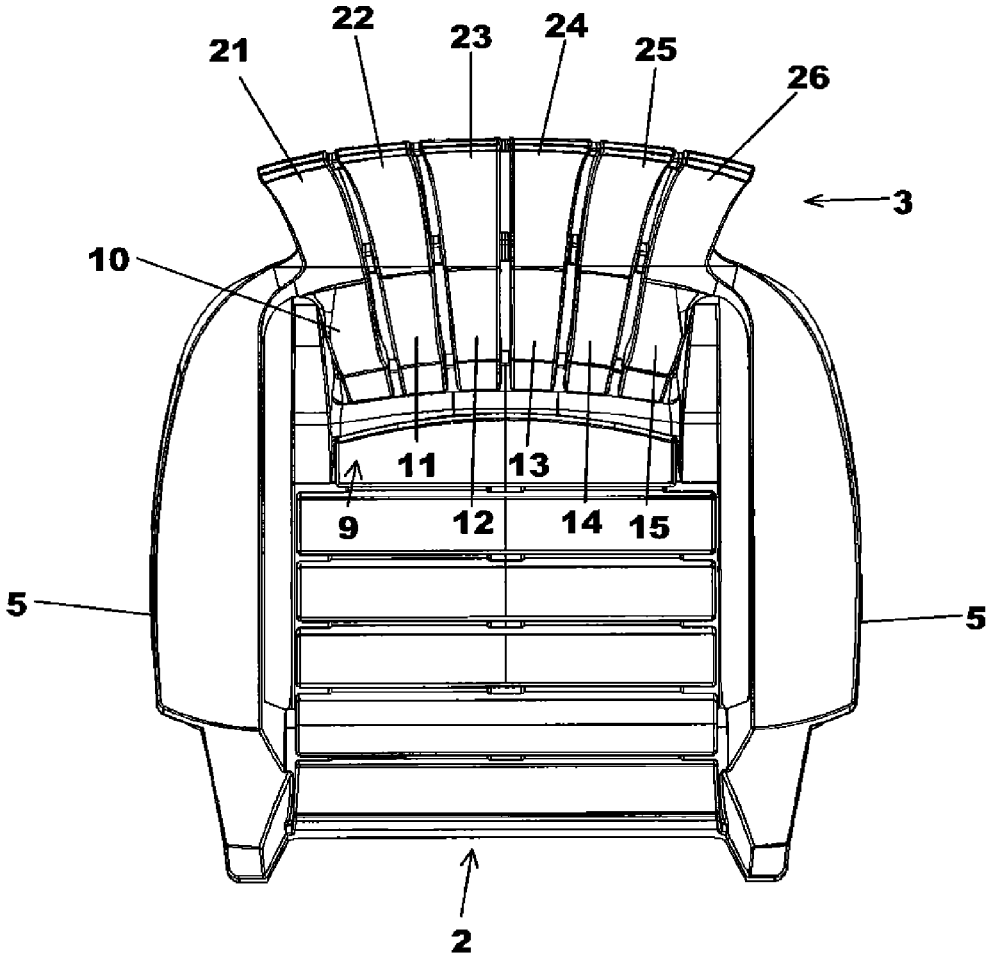
FIG. 3 is a top view of the first present preferred embodiment of the Adirondack chair.
Figure 4:
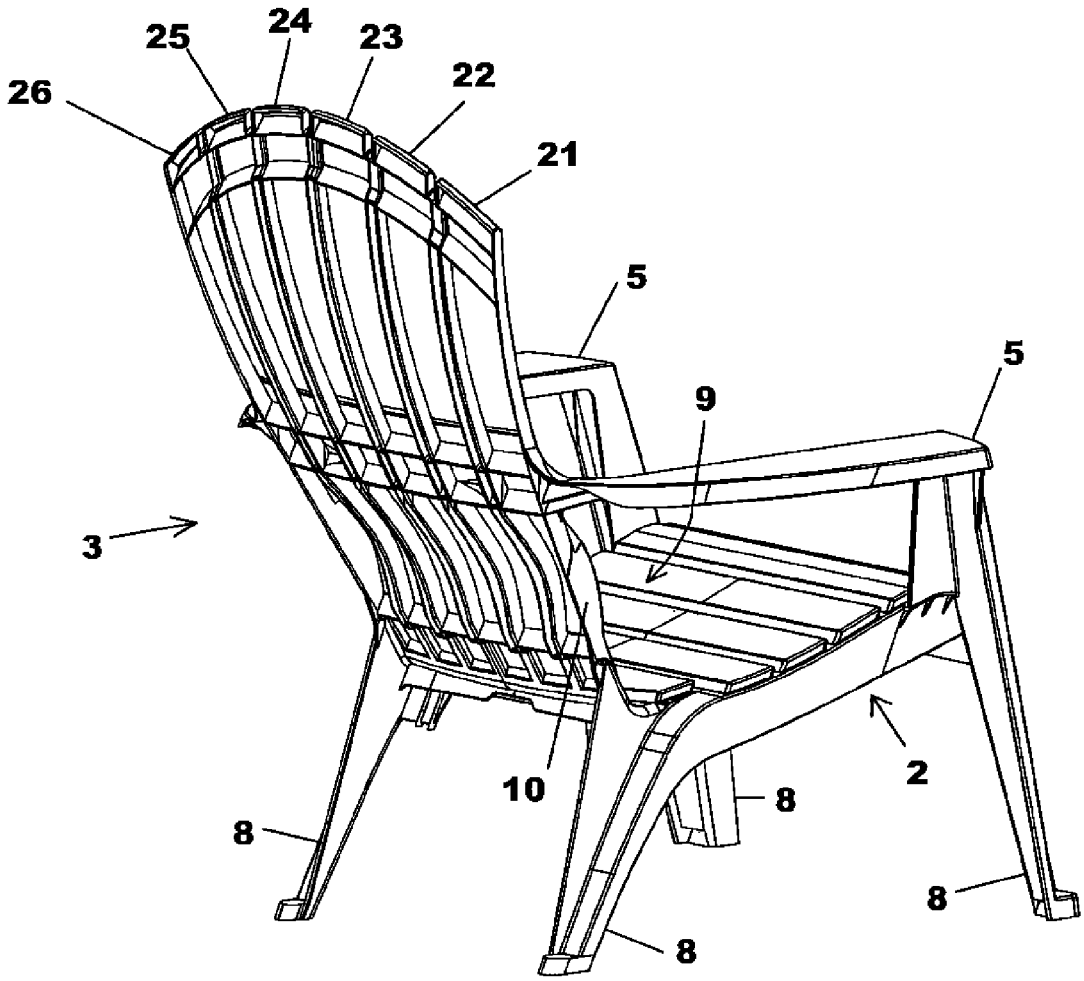
FIG. 4 is a rear perspective view of the first present preferred embodiment of the Adirondack chair.
Figure 5:
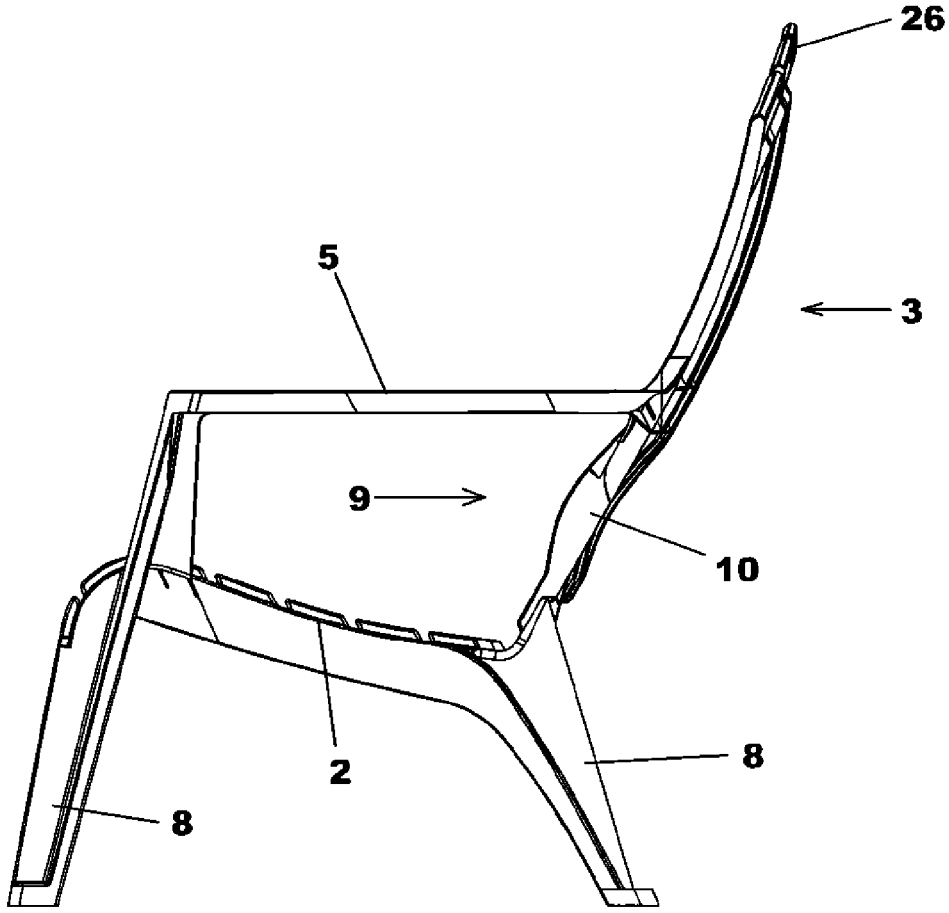
FIG. 5 is a side view of the first present preferred embodiment of the Adirondack chair.
Figure 6:
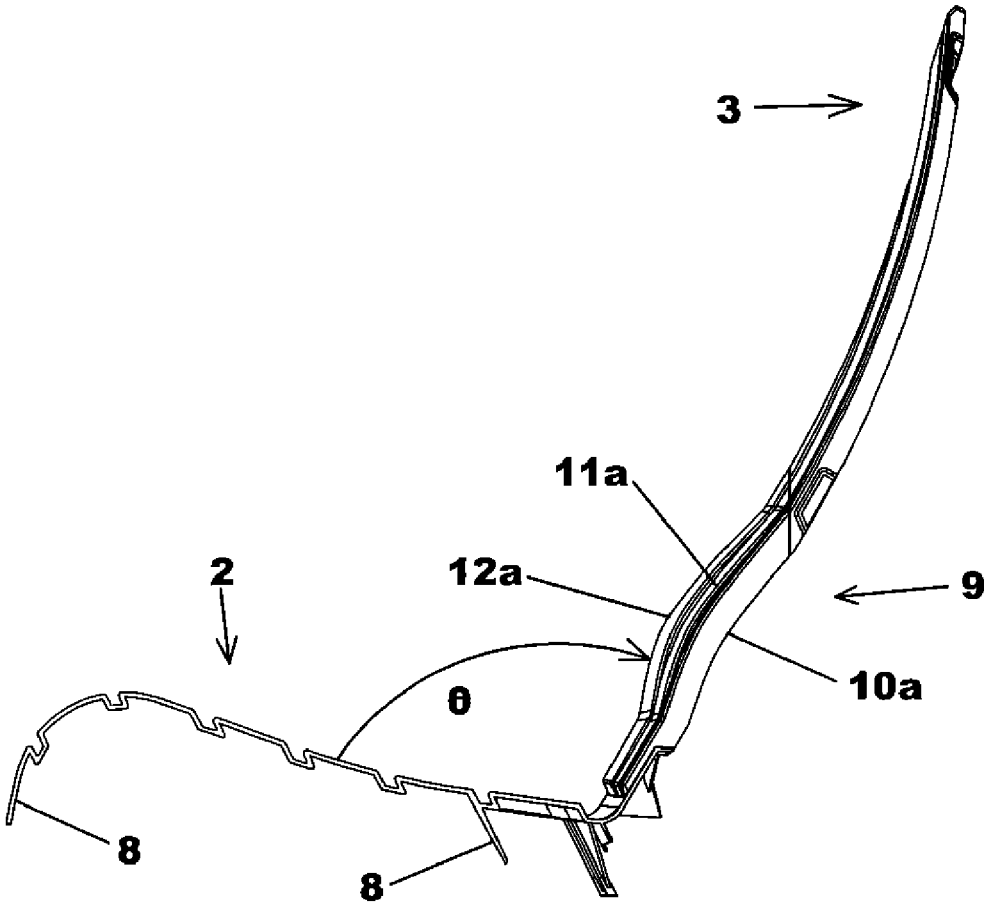
FIG. 6 is a schematic view of the seat and back of the first present preferred embodiment of the Adirondack chair.

Referring to FIGS. 1-6, a first present preferred embodiment of an Adirondack chair 1 includes a seat 2 attached to a back 3. The seat 2 and back 3 are supported by a chair base 7 that includes a plurality of legs 8. A lumbar support 9 is attached to the chair back 3. Armrests 5 are attached to the back 3 of the chair and the seat 2. The armrest 5, back 3, seat 2 and base 7 are integrally molded as a unitary structure. Preferably, the chair 1 is formed by injection molding and is composed of a polymeric material such as polycarbonate, ABS, polypropylene or other plastics. The material of the lumbar support 9 may be softer than the material of the back, seat, armrests, or base. Preferably, the lumbar support 9 is formed by injection molding or foam injection molding.

The back 3 of the chair includes a plurality of members. The members include a first member 21, a second member 22, a third member 23, a fourth member 24, a fifth member 25 and a sixth member 26. A gap is formed between each member. Each gap preferably extends from the top of the back 3 to the bottom of the back.

Preferably, the back members are arranged to provide a gap along a center portion of the back that is designed to align with a seated user's spine. By providing a central gap, a user that may suffer from spinal stenosis can avoid having his or her spine or at least the bony projections of the user's spine in engagement with a lumbar support or back member slat when sitting in the chair. Such a central gap can reduce irritation to the user's spine and improve the comfort experienced by a seated user suffering from spinal stenosis.

The lumbar support 9 is integral with the back 3. The lumbar support 9 includes a first support 10 provided on the first back member 21, a second support 11 on the second back member 22, a third support 12 on the third back member 23, a fourth support 13 on the fourth back member 24, a fifth support 14 on the fifth back member 25 and a sixth support 15 on the sixth back member 26. Preferably, the lumbar supports do not extend over the gaps formed between the back members. The lumbar support has a longitudinally convex front surface that is defined by the supports 10, 11, 12, 13, 14, and 15. The supports are all longitudinally convex such that the middle portion of each support extends forwardly more than the top or bottom portions of the support.

The supports also define a laterally concave front surface of the lumbar support 9. Supports 10 and 15 are thicker than the other supports. Supports 11 and 14 are thicker than supports 12 and 13, but thinner than supports 10 and 15. For instance, as may be appreciated from FIG. 6, the first support 10 has an outermost portion 10*a* that defines the thickness of the support 10 that is less than the thickness of the second support 11 and the third support 12. The second support 11 has an outermost portion 11*a* that defines the thickness of the support that is less than the thickness of the third support 12. The third support 12 has an outermost portion 12*a* that is thicker than the second support 11 and the first support 10.

The back 3 may be resilient such that the back 3 can slightly flex when supporting a seated user's back. As may be best seen in FIG. 6, the back 3 extends from the seat 2 on an angle $\Theta$ relative to the seat 2. Preferably the angle $\Theta$ is between 95° and 115°.

Preferably the material of the lumbar support is softer or more flexible than the material of the back, seat, armrests, or base. Preferably, the lumbar support is formed of cushioning material, foam material, or material that is used in a foam injection molding process to allow the material to foam when molding the lumbar support to provide cushioning for the lumbar support.

Figure 7:
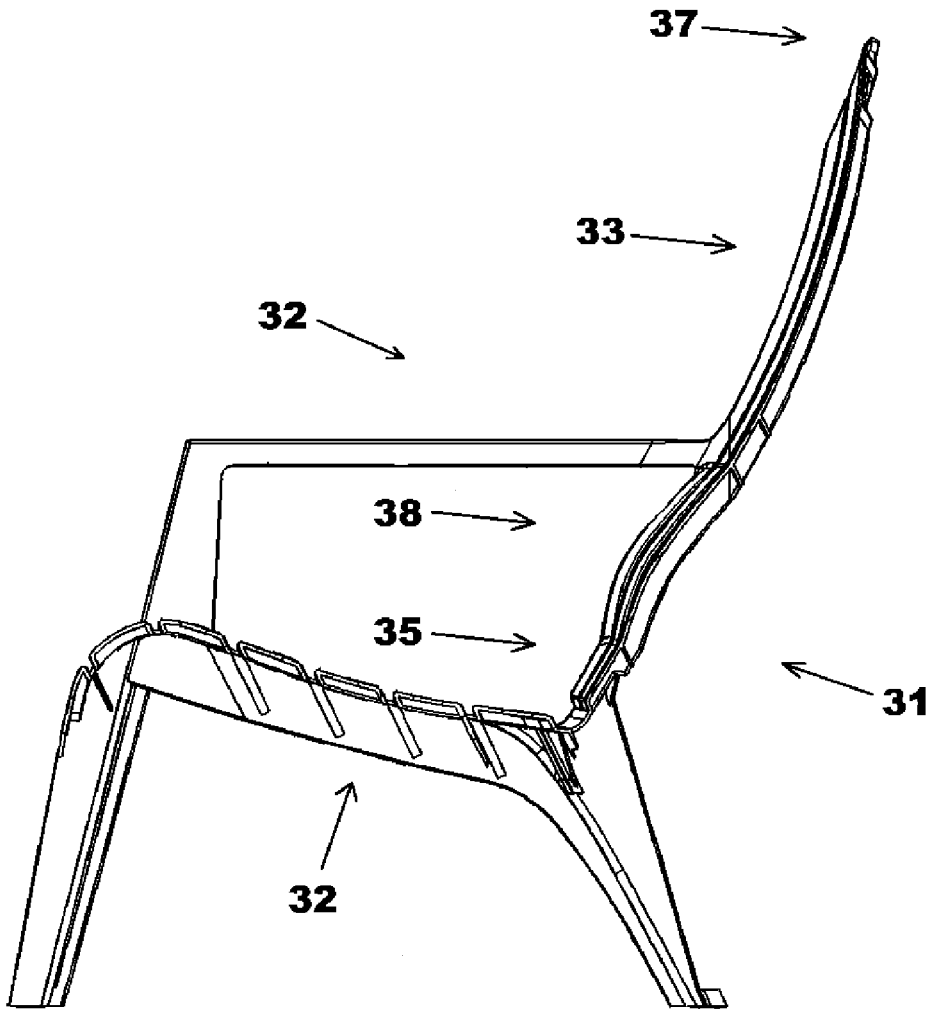
FIG. 7 is a side view of a second present preferred embodiment of the Adirondack chair with an armrest cut away to more clearly illustrate the back of the chair.

A second present preferred embodiment of the Adirondack chair 31 is shown in FIG. 7. The chair 31 includes a seat 32 attached to a back 33. The back 33 includes a top portion 37, and a middle portion 38. A lumbar support 35 is attached to the back 33. The top portion 37 is preferably configured to curve forwardly relative to the middle portion 38 such that the top portion 37 extends forwardly and above the outermost portion of the lumbar support 35 so that the top portion 37 defines a headrest. It should be appreciated that the back 33 may be formed by a plurality of back members similar to the back 3 of the first present preferred embodiment of the Adirondack chair 1 shown in FIGS. 1-6.

Preferably, the top portion 37 of the back 33 extends about four to five inches forward more than the top portion would extend if it was straight. Because the top portion 37 extends forwardly and is curved, the back 33 may be longer than backs of typical Adirondack chairs that include straight backs. Preferably, the curvature of the back 33 may cause the back 33 to be as much as two inches longer than a traditional straight back.

The top portion 37 is preferably formed to provide a place to rest a user's head. The surface of the top portion 37 is preferably formed without acute angles that would make sitting with the head resting on the top portion 37 to be uncomfortable. In some embodiments, only the center members of the top portion 37 may be sized and configured to provide a headrest by having a surface that has no acute angles.

The forwardly extending top portion 37 engages the head of a user and resiliently supports the head of a seated user. The resilient support of the curved top portion 37 has been found to greatly increase the comfort of a seated user. Further, the resilient support of the top portion 37 has been found to provide a slight resilient outward flex to the lumbar support 35, which provides a slight additional support to the lumbar region of a seated user.

A seated user has an occipital protuberance on the rear of his or her skull. When a user reclines a chair back or rests his or her head against a chair back, the occipital protuberance experiences a significant amount of pressure exerted by the user's head weighing against the chair back. Such pressure increases significantly as the chair is reclined to a position closer to being perfectly horizontal. Since the Adirondack chair back is initially in a reclined position, the occipital protuberance of a seated user can experience significant discomfort due to the weight of the user's head acting against the occipital protuberance engaging the chair back. For instance, the amount of pressure exerted on a seated user's occipital protuberance may be between 25 and 35% greater than the pressure experienced by a user seated in a chair with a perfectly vertical chair back. If a user can recline the chair back of the Adirondack chair, the pressure exerted on the occipital protuberance may also increase.

Preferably, the top portion of the chair back is brought forward, either by curve or angle, between 2.5 and 4.5 inches from the plane of the back which is at a 25° to 35° angle from vertical. Most preferably, the top portion of the back is sized and configured such that no acute angles exist on the top of the central back members that may cause unnecessary discomfort to the external occipital protuberance on the rear of a seated user's skull. A radius of 1 inch to 2 inches where a seated user's head is to contact the top of the rear center slats forming the headrest may be used to help avoid such discomfort.

Indeed, embodiments of our Adirondack chair that include an inwardly curving upper back reduces that pressure experienced by the occipital protuberance of a seated user, which, combined with the radius of the top portion of the chair back, minimizes or eliminates the discomfort caused by compressing the skin and capillaries within it against the hard back of the chair or acute angles thereon. Comparative testing was conducted to determine the amount of force exerted on the back of the head while a user is seated in a chair of the prior art and an embodiment of our new chair.

The conducted testing included modifying the back of a prior art plastic Adirondack chair disclosed in U.S. Patent Application Publication No. 2006/0163920 and an embodiment of an Adirondack chair discussed above and shown in FIG. 7 to measure the weight exerted on the top portion of the back for each of these chairs. The weight was measured by a scale attached to the top portion of the chair backs. The testing was conducted using different testers having weights ranging from 140 pounds to 220 pounds. In addition to a tester's weight, the tester's posture also affected the amount of weight applied to the top portion of the chair backs.

The weight exerted by the seated testers' heads on the top portion of the backrest for the chair disclosed in U.S. Patent Application Publication No. 2006/0163920 was measured to be an average of 5.35 pounds. The average weight exerted by the heads of the seated testers on the top portion of the backrest for an embodiment of our chair shown in FIG. 7 was 2.45 pounds, which provides an effective weight reduction of at least 54%. It should be appreciated that the radius of the top portion of the back helps to further reduce the pressure exerted by the weight of the head so that the pressure experienced by the occipital protuberance of a seated user in embodiments of our chair is more than 54% less than the pressure experienced by users seated in chairs of the prior art.

Figure 8:
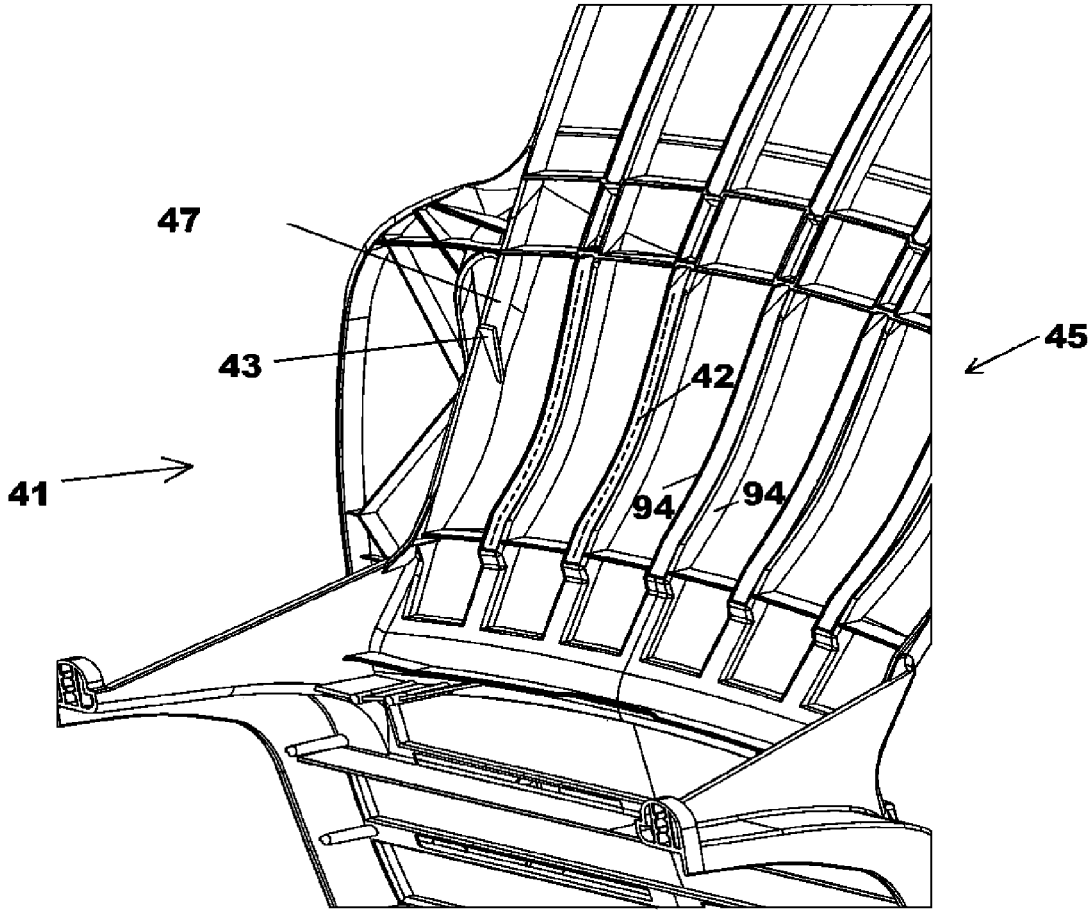
FIG. 8 is a fragmentary view of a third present preferred embodiment of the Adirondack chair.
Figure 9:
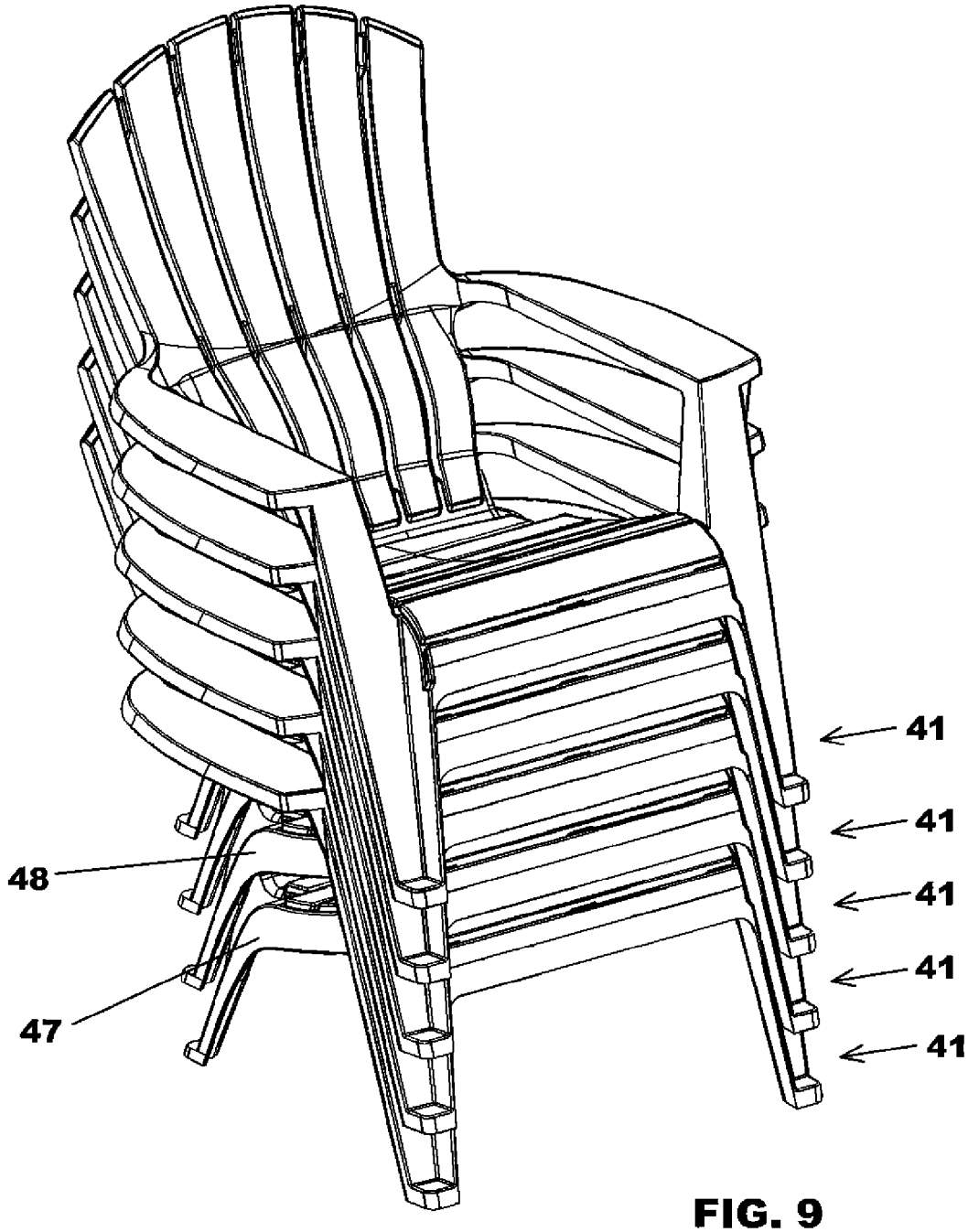
FIG. 9 is a perspective view of multiple third present preferred embodiments in a substantially straight stack.
Figure 10:
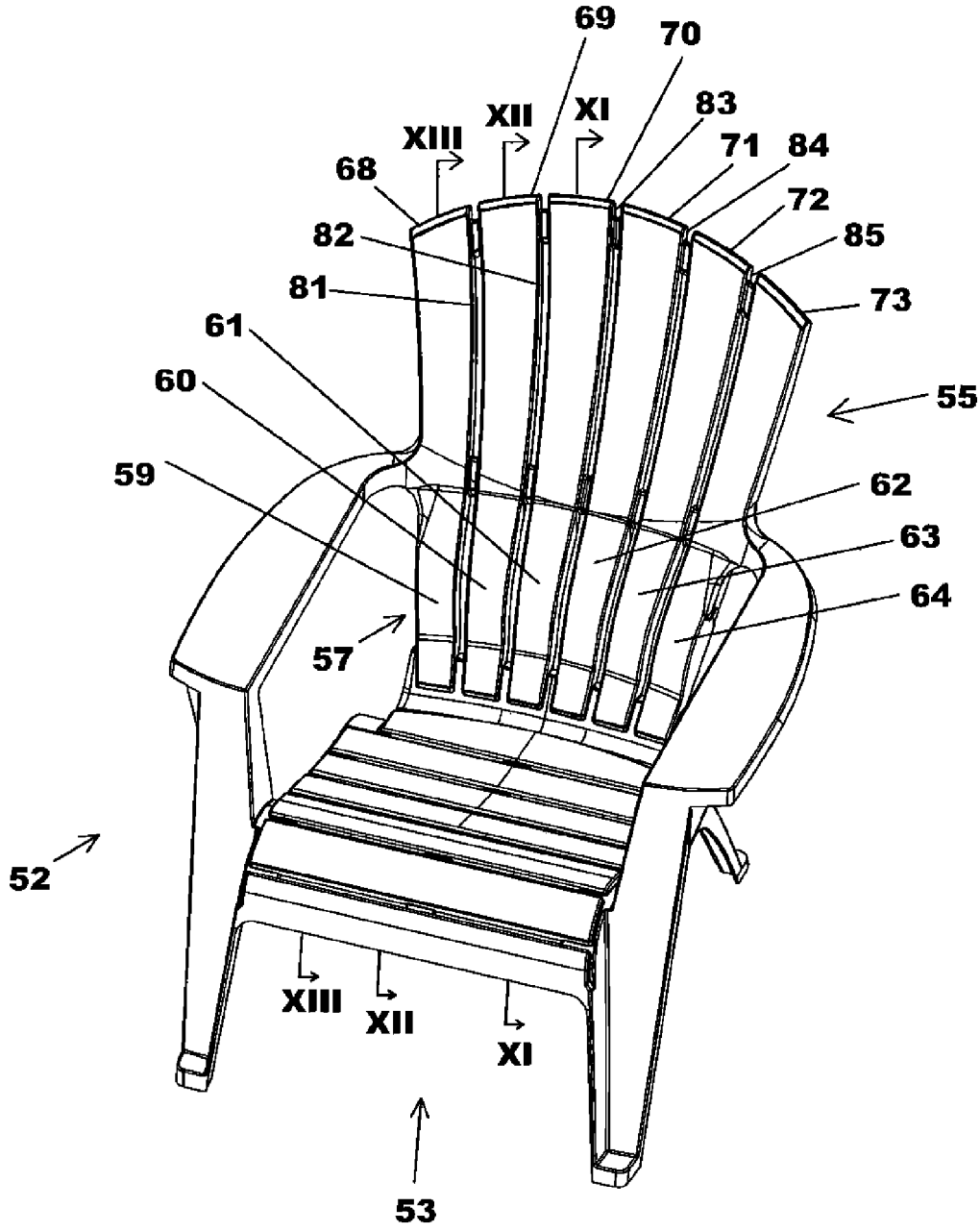
FIG. 10 is a front perspective view of a fourth present preferred embodiment of the Adirondack chair.
Figure 11:
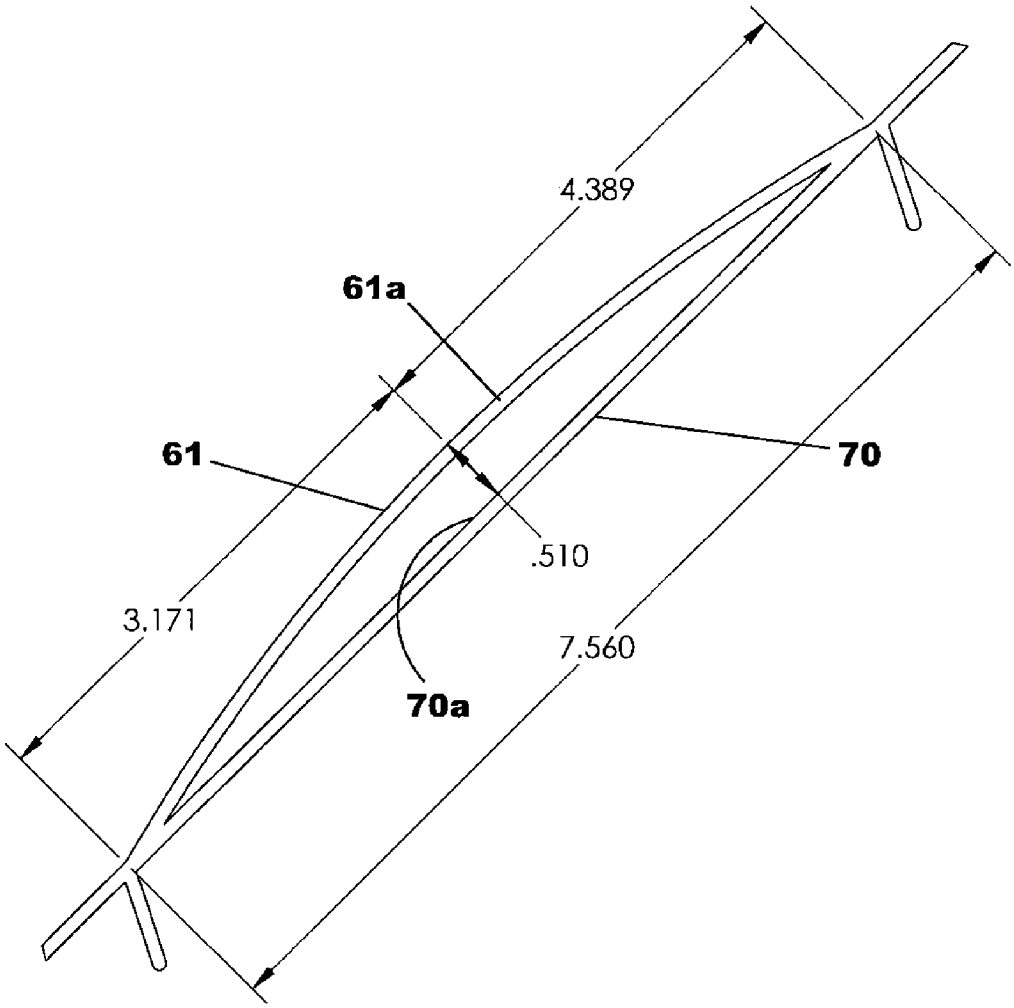
FIG. 11 is a cross sectional view of the fourth present preferred embodiment of the Adirondack chair taken along line XI-XI in FIG. 10 that illustrates the convex shape and configuration of the third support member of the lumbar support.
Figure 12:
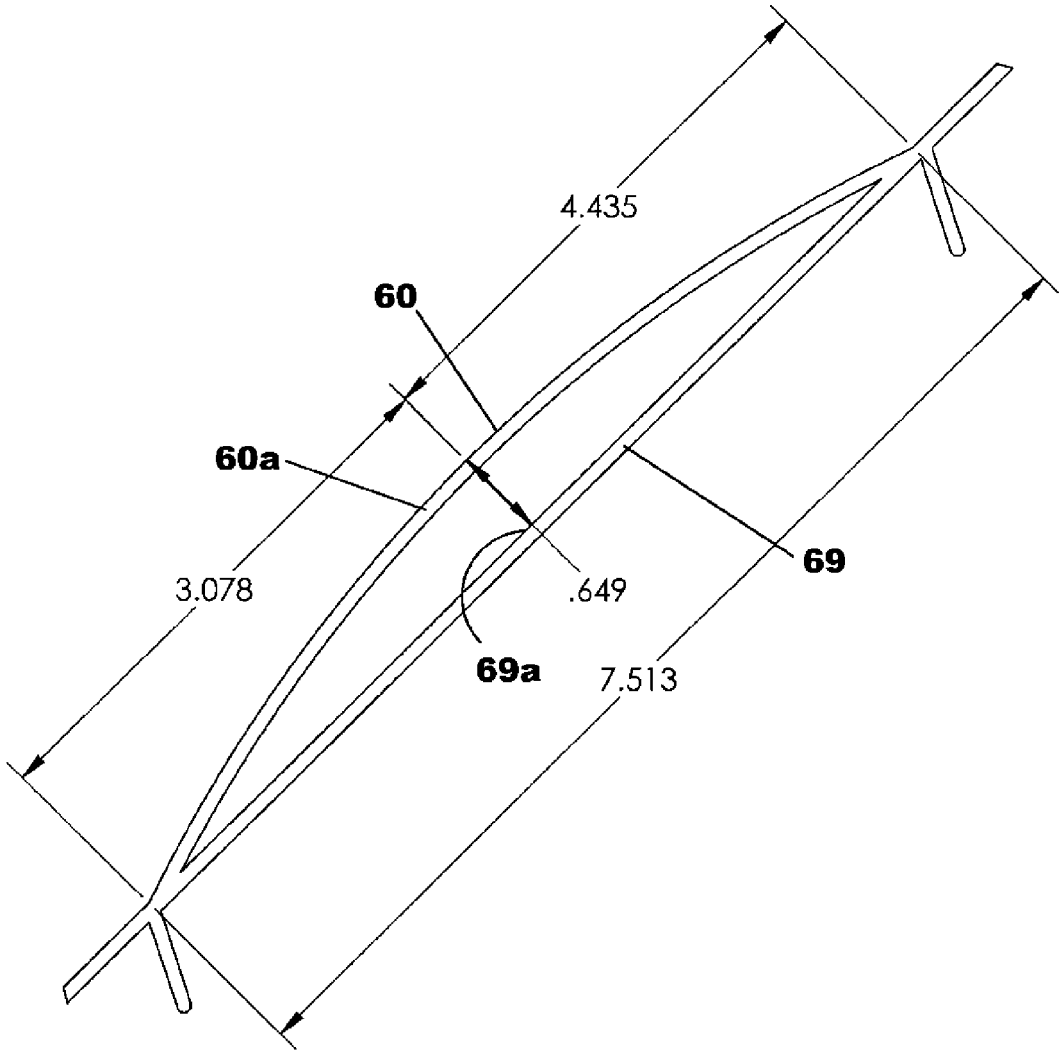
FIG. 12 is a cross sectional view of the fourth present preferred embodiment of the Adirondack chair taken along line XII-XII in FIG. 10 that illustrates the convex shape and configuration of the second support member of the lumbar support.
Figure 13:
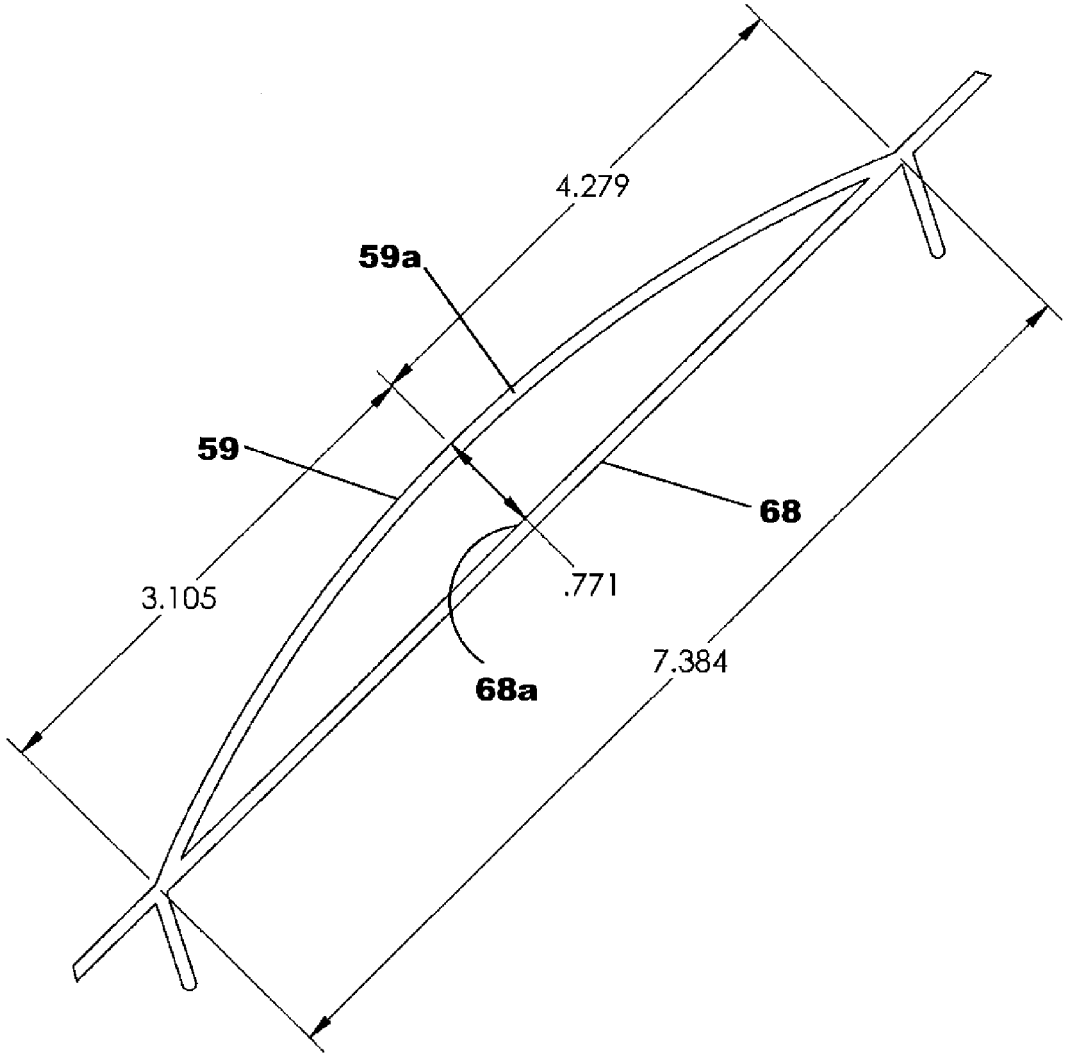
FIG. 13 is a cross sectional view of the fourth present preferred embodiment of the Adirondack chair taken along line XIII-XIII in FIG. 10 that illustrates the convex shape and configuration of the first support member of the lumbar support.

Referring to FIGS. 8 and 9, a third embodiment of the Adirondack chair 41 is formed much like the first or second embodiments discussed above. The legs of the chair are sized and configured to permit one chair to be nested within a second lower chair when the chairs are stacked. The back 45 of the chair 41 also includes at least one rib 43 attached to the back 45 of the chair. The rib 43 may be attached to a back member that defines a portion of the back 45. The rib 43 is sized and configured to extend beyond the rear of the back so that the rib 43 can engage the front of the back of another Adirondack chair when the chairs are stacked. Such engagement helps keep the stacked chairs straight.

For instance, as may be seen in FIG. 9, a number of chairs 41 are stacked. The stacked chairs 41 are stacked such that they are in a substantially straight stack. The ribs 43 that extend from the back of each chair helps keep the stack substantially straight. For example, the bottommost chair 47 supports stacked chair 48. The rib or ribs that extend from the back of the upper chair 48 engages the front of the chair back of the bottom chair 47. The engagement of the rib or ribs helps keep the upper chair 48 parallel with the lower chair 47 and helps keeps the stacked chairs in a substantially straight stack. The ribs 43 of each chair can also be sized and configured to resist breakage that may occur when the chair stacks are in transit by causing the weight of each chair to be spread out over the lower chairs of the stack.

Preferably, the chairs 41 are stacked to transport the chairs to a retailer who then sells the chairs. The chairs may be sold by a retailer while they are stacked such that a customer pulls the top most chair in the stack off the stack to carry to a register to then purchase the chair. The straightness of the stack keeps the stack stable and reduces the likelihood that a customer could accidentally topple the stack by leaning against the stack or by moving a top chair off the stack. The straightness of the stack also helps prevent the stack from falling due to other forces that may act on the stacked chairs when the stack is moved when delivering the chairs to the retailer or when the stack is moved by the retailer.

Testing of the chairs 41 having ribs 43 was conducted to ensure that the stacked chairs 41 would provide a stable stack that was safe for consumers. Testing determined that the ribs 43 can be sized and configured to provide a stack of twenty-four chairs in a strong, stable vertical stack. Such testing included stacking chairs 41 that included the ribs 43 to various heights and determining the amount of force necessary to topple the stack.

In some embodiments of the Adirondack chair, multiple ribs may be attached to the same back member or to respective back members. The ribs are preferably integrally molded with the back of the chair and the other components of the chair. In alternative embodiments, the ribs may be fastened to the back of the chair by connectors or by bonding the ribs to the back of the chair.

Figure 14:
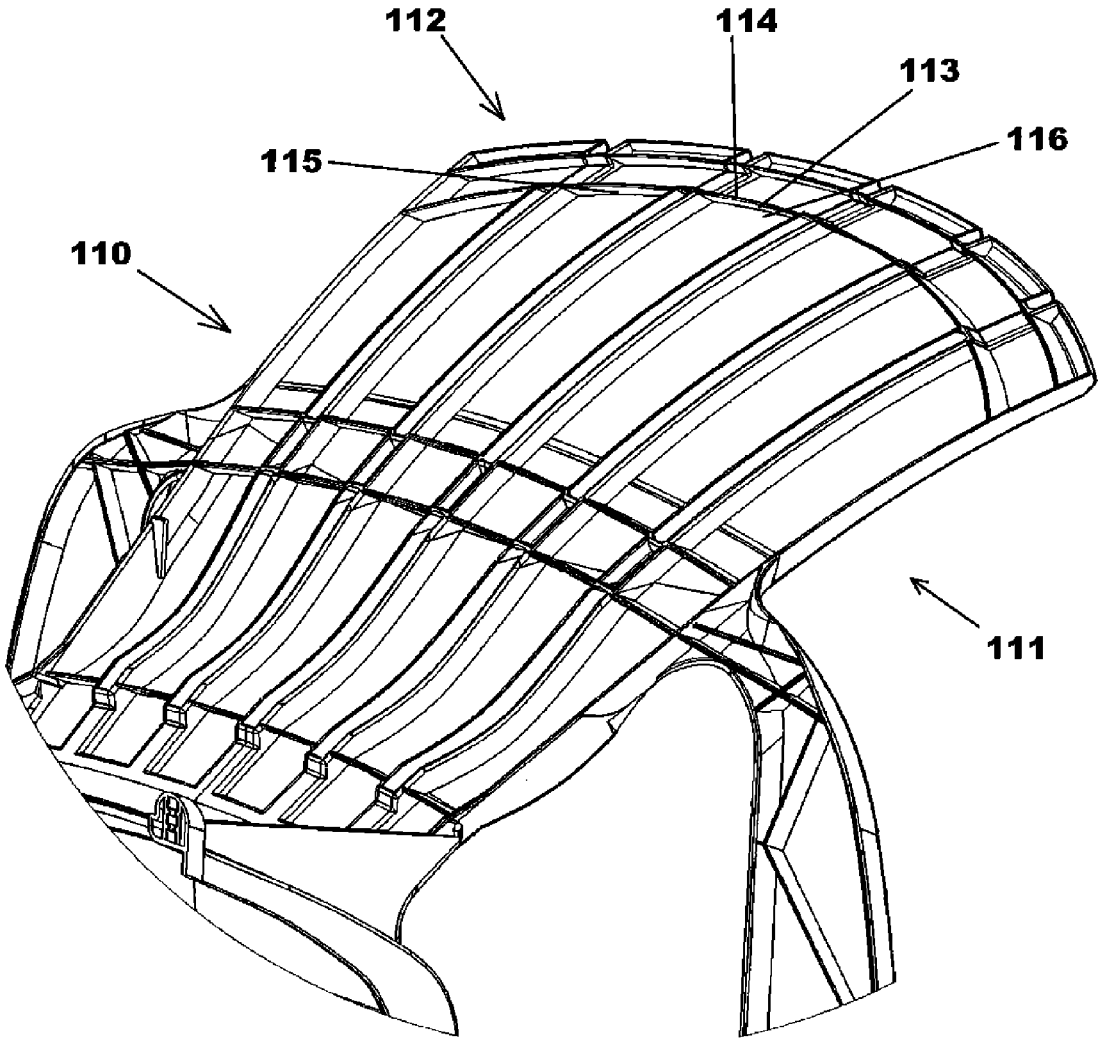
FIG. 14 is a rear fragmentary view of a fifth present preferred embodiment of the Adirondack chair.

Embodiments of our Adirondack chair 110 may also include ribs that extend from the top portion 112 of the chair back 111, as may be seen in FIG. 14. Each member of the chair back has a rib 113 that extends rearwardly from the top portion of that member. Each rib or a plurality of the ribs 113 may provide a handle 114 sized and configured to permit a user to lift the chair or carry the chair. The handle 114 is preferably defined by one or more ribs 113 that extend rearwardly and downwardly to form a gap 115 sufficiently sized for at least a few fingers of a hand to be positioned between the one or more ribs 113 and the rear portion 116 of the one or more chair back members.

The supports of the lumbar supports may be configured to have the same flexibility or have different flexibilities. For example, one or more of the supports of the lumbar support may have sidewalls 94 that extend behind and substantially perpendicular to the front surface of the support, as shown in FIG. 8. The sidewalls 94 may be longer or shorter than the sidewalls of other supports. For instance, a support 44 may have sidewalls 42, which are shown in dotted line, that are narrower than the sidewalls of other supports. The narrower sidewalls permit the supports to be more flexible. Preferably, the sidewalls 94 are 0.65 to 0.75 inches and the narrower sidewalls 42 are 0.25 to 0.325 inches. It is also contemplated that the lumbar supports may have no sidewalls and merely consist of a front surface. The use of thinner sidewalls 42 or no sidewalls can improve the flexibility of the supports and the lumbar support.

Preferably, the distance that the sidewalls extend behind the front surface of the supports is not constant. Most preferably, the sidewalls extend less in the center of each support than at the top and bottom of the support to provide the center portion of the support with more flexibility relative to the top and bottom portions of the support, as may be seen in the sidewalls 99 of the support 98 shown in FIG. 8A. It should be appreciated that the supports, such as support 98, may be integral with the members of the back and form a portion of the members of the back.

Figure 8A:
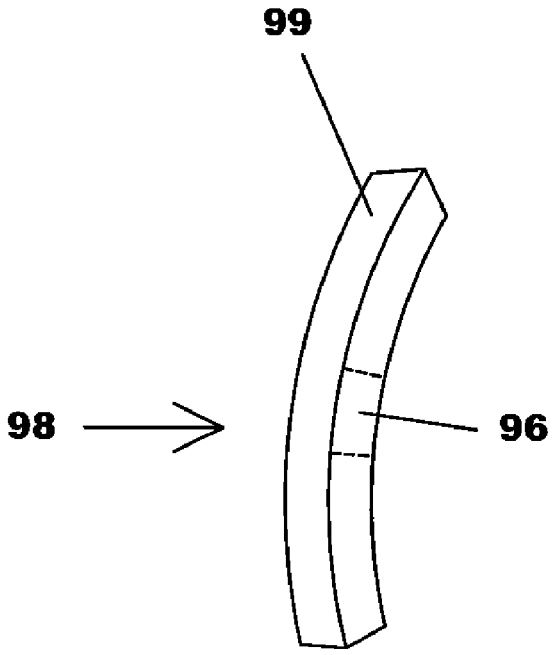
FIG. 8A is a fragmentary view of a present preferred support of the lumbar support.

As may be appreciated from FIG. 8A, it is also contemplated that portions of the sidewalls 99 of the supports 98 may have openings or recesses formed therein. Such recesses may permit increased flexibility in one or more portions of the support 98. For instance, the sidewall may have a gap 96 formed therein, as shown in dotted line in FIG. 8A.

Referring to FIGS. 10-13, a fourth present preferred embodiment of the Adirondack chair 52 is shown. The chair 52 has a seat 53 that is attached to the back 55. A lumbar support 57 is also attached to the back 55. The back is defined by a plurality of back members that extend on an angle from the seat. The first back member 68 is positioned adjacent to the second back member 69 to define a first gap 81. The second back member 69 is positioned adjacent to the third back member 70 to define a second gap 82. The third back member 70 is positioned adjacent the fourth back member 71 to define a third gap 83. The fourth back member 71 is positioned the fifth back member 72 to define a fourth gap 84. The fifth back member 72 is positioned adjacent the sixth back member 73 to define a fifth gap 84. Each back member extends from the seat and is integral with the seat 53.

The lumbar support 57 includes a first support 59 attached to the first back member 68, a second support 60 attached to the second back member 69, a third support 61 attached to a third back member 70, a fourth support 62 attached to the fourth back member 71, a fifth support 63 attached to the fifth back member 72 and a sixth support 64 attached to the sixth back member 73. Each support is integral with the back member to which it is attached. The supports do not cover the gaps. The supports 59, 60, 61, 62, 63 and 64 define a lumbar support that has a longitudinally convex front surface and a laterally concave front surface.

The third support 61 preferably has a thickness of 0.51 inches. As may be appreciated from FIG. 11, the outermost portion 61*a* of the third support 61 is 0.51 inches away from the front surface 70*a* of the third back member 70. The fourth support 62 has the same thickness and shape as the third support 61, The second support 60 preferably has a thickness of 0.649 inches. As may be seen in FIG. 12, the outermost portion 6*oa* of the second support 60 is 0.649 inches away from the front surface 69*a* of the third back member 69. The fifth support 63 has the same thickness and shape as the second support 60.

The first support 59 is preferably 0.771 inches thick. The outermost portion 59*a* of the first support 59 is 0.771 inches away from the front surface 68*a* of the first back member 68, as may be appreciated from FIG. 13. The sixth support 64 has the same thickness and shape as the first support 59.

It should be appreciated that the thickness of each support is defined by the distance between the outermost portion of the support and the front of the back. If the supports and back are integral with each other, the front surface of the back may be identified by assuming the lower portion of the back to which the lumbar support is attached straightly extends from the seat. As should be appreciated from those skilled in the art, the front surface of the back member attached to each support may then be calculated based on this understanding.

The lumbar support 57 includes a convex longitudinal shape. Each support of the lumbar support 57 is convex in the longitudinal direction to define a front longitudinal convex surface. Preferably, the outermost portion of each support is in the middle of the support and the front longitudinal convex surface defines an arc.

We tested various configurations and positions of the lumbar support. The testing revealed that the position, shape and thickness of each support of the lumbar support 57 all affected user comfort. Therefore, we tried to find the combination of these factors that offered the most comfort to the most people. The conducted testing included having people sit in Adirondack chairs of various different lumbar support sizes and configurations. The test sitters were selected to have heights that ranged from five feet tall to six feet and two inches tall. The test sitters weighed 250 pounds or less. The testing included providing a lumbar support that was separate from the back of an Adirondack chair. The lumbar support was movable so multiple positions of the lumbar support could be tested in one sitting. The testers were questioned to identify the comfort level associated with different positions of the lumbar support and to determine whether a larger or smaller lumbar support would be preferred.

Initial lumbar support designs that were tested started with positioning the movable lumbar support at a lower position that was on the back of an Adirondack chair at a position that was about two inches above a portion of the seat. This lumbar support design was found to be uncomfortable to many users. Surprisingly, lumbar supports that were positioned higher than the initial design were preferred by most test sitters. Through questioning of the testers and further testing, it was also determined that larger lumbar supports were preferred by the test sitters. The most preferred size and location of the lumbar support 57 included a lumbar support 57 that extended from about 3.5 inches above a portion of the seat to about 11 inches above the seat.

Further, the lumbar support 57 has been found to not decrease the comfort of those seated users. For instance, the lumbar support does not project outward such that it painfully or annoyingly contacts an upper portion of a relatively short or relatively tall person. For example, a person that is 5 feet tall and a person that is 6 feet and two inches tall may all comfortably sit in the chair 52.

Preferably, embodiments of the Adirondack chair are formed by injection molding. In some embodiments, the entire chair structure may be formed by injection molding. In one embodiment, material may be injected into a mold for the back, base and chair and allowed to cure or at least partially cure. Then, material for the lumbar support may be co-injected into the mold at a particular location on the back to form the lumbar support. Preferably, the co-injected material for the lumbar support is injected such that it is allowed to foam to allow the lumbar support to provide cushioning. For some material options, the foam injection of the lumbar support may be conducted first, and the other portions of the chair may then be co-injected into a mold to form the chair. The material of the lumbar support may have a pigment or color additive that provide the lumbar support with the same color as the other chair components or a color that is complimentary to the color of the other chair components.

It is also contemplated that one could provide a formed lumbar support as an insert into a mold of a chair. The remaining portions of the chair could then be molded around the lumbar support to form the chair.

It should be appreciated that other variations of the present preferred embodiments discussed above may be made. For example, the lumbar support may cover gaps between back members. As an additional example, the back can be formed by less than six back members or more than six back members. As yet another example, embodiments of the chair may be formed by bonding various molded components together or by other fabrication processes known to those of ordinary skill in the art.

While certain present preferred Adirondack chairs and certain present preferred methods making and using the same have been discussed and illustrated herein, it is to be distinctly understood that the invention is not limited thereto but may be otherwise variously embodied and practiced within the scope of the following claims.

We claim:

1. An Adirondack chair composed of a polymeric material comprising:

a seat;

a back attached to the seat, the back having a plurality of side by side members, each of the members extending upwardly from the seat at an angle of 95° to 115° relative to at least a portion of the seat to define a laterally concave front surface;

a lumbar support attached to the back, the lumbar support having a plurality of supports that together define at least one front surface which is longitudinally convex and laterally concave, each support attached to a respective member of the plurality of members of the back;

wherein the seat, back and lumbar support are integrally molded as a unitary structure; and wherein the plurality of members of the back are comprised of a first member, a second member, a third member, a fourth member, a fifth member and a sixth member positioned adjacent to each other such that a first gap is defined between the first member and the second member, a second gap is defined between the second member and the third member, a third gap is defined between the third member and the fourth member, a fourth gap is defined between the fourth member and the fifth member and a fifth gap is defined between the fifth member and the sixth member.

2. The Adirondack chair of claim 1 wherein at least one of the supports of the lumbar support has a front surface extending between a first sidewall and a second sidewall opposite the first sidewall, the first and second sidewalls extending between 0.325 inches and 0.25 inches behind the front surface of the at least one support of the lumbar support such that the first and second sidewalls are substantially perpendicular to the front surface of the at least one support of the lumbar support.

3. The Adirondack chair of claim 1 wherein the plurality of supports is comprised of a first longitudinally convex support attached to the first member, a second longitudinally convex support attached to the second member, a third longitudinally convex support attached to the third member, a fourth longitudinally convex support attached to the fourth member, a fifth longitudinally convex support attached to the fifth member and a sixth longitudinally convex support attached to the sixth member wherein the supports of the lumbar support do not cover at least one of the first gap, second gap, third gap, fourth gap and fifth gap.

4. The Adirondack chair of claim 1 wherein the plurality of supports is comprised of a first longitudinally convex support attached to the first member, a second longitudinally convex support attached to the second member, a third longitudinally convex support attached to the third member, a fourth longitudinally convex support attached to the fourth member, a fifth longitudinally convex support attached to the fifth member and a sixth longitudinally convex support attached to the sixth member wherein the first support and sixth support each have a maximum thickness of 0.77 inches, the second support and fifth support each have a maximum thickness of 0.65 inches and the third support and fourth support each have a maximum thickness of 0.51 inches.

5. The Adirondack chair of claim 1 further comprising armrests attached to the back.

6. The Adirondack chair of claim 1 further comprising a base attached to at least one of the seat and the back.

7. The Adirondack chair of claim 1 further comprising at least one rib extending rearwardly and downwardly from a top portion of at least one of the chair back members to define a gap between the at least one rib and the at least one chair back member from which the at least one rib extends, the at least one rib being sized and configured to form a handle.

8. The Adirondack chair of claim 1 further comprising at least one rib and wherein each member of the plurality of members has a front and a rear, the rib attached to at least one member of the plurality of members such that the at least one rib extends beyond the rear of the at least one member.

9. The Adirondack chair of claim 8 wherein the rib is sized and configured to engage a chair back of another Adirondack chair to permit substantially straight chair stacking.

10. An Adirondack chair composed of a polymeric material comprising:

a seat;

a back attached to the seat, the back having a plurality of side by side members, each of the members extending upwardly from the seat at an angle of 95° to 115° relative to at least a portion of the seat to define a laterally concave front surface;

a lumbar support attached to the back, the lumbar support having a plurality of supports that together define at least one front surface which is longitudinally convex and laterally concave, each support attached to a respective member of the plurality of members of the back;

wherein the seat, back and lumbar support are integrally molded as a unitary structure; and wherein each member of the plurality of members has a top portion, a middle portion and a bottom portion, the top portion extending forwardly relative to the middle portion and extending to a position located above and in front of the longitudinally convex front surface of the lumbar support.

11. The Adirondack chair of claim 10 wherein the top portions of the plurality of members located in a center portion of the back defines a head rest.

12. An Adirondack chair composed of a polymeric material comprising:

a seat;

a back attached to the seat, the back being at an angle of 95° to 115° relative to at least a portion of the seat; and a lumbar support attached to the back, the lumbar support having a longitudinally convex front surface, the lumbar support extending from about 3.5 inches above a portion of the seat to about 11 inches above the portion of the seat such that a portion of the longitudinally convex front surface of the lumbar support is about 0.5 inches away from the back; and wherein the seat, back and lumbar support are integrally molded as a unitary structure;

wherein the lumbar support is comprised of at least one support attached to the back, the at least one support of the lumbar support having a front surface extending between a first sidewall and a second sidewall opposite the first sidewall, the first and second sidewalls extending behind the front surface of the at least one support of the lumbar support such that the first and second sidewalls are substantially perpendicular to the front surface of the at least one support of the lumbar support; and wherein the first sidewall extends behind the front surface of the at least one support less in a middle portion of the first sidewall than in top or bottom portions of the first sidewall and wherein the second sidewall extends behind the front surface of the at least one support less in a middle portion of the second sidewall than in top or bottom portions of the second sidewall.

13. The Adirondack chair of claim 12 wherein at least one of the first sidewall and the second sidewall defines at least one recess.

* * * * *